US005380981A

United States Patent [19]

Feldman et al.

[11] Patent Number: 5,380,981

[45] Date of Patent: Jan. 10, 1995

[54] ECONOMICAL BATHROOM MIRROR HEATER

[76] Inventors: Bernard Feldman, 503-A Avenida Sevilla, Laguna Hills, Calif. 92653; Dusan P. Pope, 28080 N. Caraway La., Saugus, Calif. 91350

[21] Appl. No.: 57,713

[22] Filed: May 4, 1993

[51] Int. Cl.[6] ..... H05B 1/00

[52] U.S. Cl. ..... 219/219

[58] Field of Search ..... 219/219, 543; 392/430, 392/432, 435, 436

[56] References Cited

U.S. PATENT DOCUMENTS

| | | | |
|---|---|---|---|
| 3,757,087 | 9/1973 | Bernard | 219/543 |
| 4,060,712 | 11/1977 | Chang | 219/219 |
| 4,294,003 | 10/1981 | Coverstone | 392/435 |
| 4,910,388 | 3/1990 | Lorenz et al. | 219/543 |
| 4,940,317 | 7/1990 | Reuben | 219/219 |

*Primary Examiner*—Geoffrey S. Evans

[57] ABSTRACT

An electric heating unit for attachment to a rear surface of a mirror to reduce the formation of condensation on the mirror surface including a moisture resistant low heat conductivity heat barrier formed of a layer of closed cell plastic foam, a length of insulated low resistance heater wire mounted on the surface of the foam layer and connected to a voltage source, an aluminum foil covering the heater wire and the surface of the foam layer and adhesively connected thereto, an adhesive layer covering the outer surface of the aluminum foil, and a peel-off backing covering the adhesive layer to permit attachment of the heater unit to a mirror when the backing is removed. The components of the unit are selected to produce less than 120 watts per square meter of heat to a mirror to which the unit is attached.

10 Claims, 5 Drawing Sheets

ECONOMICAL BATHROOM MIRROR HEATER

BACKGROUND AND PRIOR ART

Bathrooms which include showers are prone to the fogging of mirrors. Some large bathrooms with air exhaust means do not fog up. Most smaller bathrooms with or without air exhaust means fog up as a result of the warm and humid air created by the shower activity causing moisture condensation on the cooler mirror surface.

The problem of defogging bathroom mirrors by electrical heating of the mirror has a long history. Spencer (U.S. Pat. No. 4,665,304) gives an excellent review of the patent literature and states that "none of these proposals has met with commercial success". We note that this observation still applies. He also specifies conditions of success with which we wholly agree, namely:

(a). Utilize widely available mirror glass.

(b). Compatibility with conventional mirror installations.

(c). Compliance with electrical safety codes.

(d). Economy of manufacture.

To (d) we would add: economy of operation.

Spencer cites 120 watts per square meter as the required heating to keep the mirror clear but calls for 200 watts per square meter for initial heating. Van Laethem et al. (U.S. Pat. No. 3,790,748) call for 250 watts per square meter as the heat required to prevent misting.

Chang (U.S. Pat. No. 4,060,712) claims that the surface temperature of the mirror needs to be 7–10 degrees Celsius above ambient whereas Prosser (U.S. Pat. No. 4,956,542) says that 4 degrees Fahrenheit above ambient is the temperature differential required to prevent fogging.

Sebel and Rhea (U.S. Pat. No. 3,887,788) teach the use of a printed circuit board to reduce the cost of the heater, act as a heat barrier, and reduce the danger of electrical shock.

SUMMARY OF THE INVENTION

The objects of this invention are as follows:

1. An extremely low-cost bathroom mirror heater.
2. A low operating cost bathroom mirror heater.
3. A super-safe bathroom mirror heater.
4. A readily newly installed or retrofitted heater.

Because of the complex and variable circumstances relating to conditions for creating or eliminating fog on bathroom mirrors it has been found necessary to conduct experiments in what is deemed to be a "worst-case" bathroom.

We have discovered that by an appropriately designed structure and optimization of its operating conditions our device will require approximately 100 watts per square meter to effectively keep a mirror from fogging in a very small bathroom (310 cubic feet of air space) where the water is 110 degrees Fahrenheit, the ambient air initially at 65 degrees Fahrenheit and the voltage 10% low (108 volts). Success was achieved under these conditions using an 18 watt (nominal) power supply using a 24 volt 20 watt UL approved transformer. This improvement over the prior art results in a product that can be energized all the time (analogous to a nightlight) and prevent fogging in most bathrooms under most, though not all, operating conditions. In many bathrooms it is not necessary to keep the heater energized all the time; it is sufficient to energize the heater one or two minutes before turning the shower on. For these installations wiring the heater to the light switch would result in an exceedingly low operating cost. In any case the product design permits continuous energization without compromising any of the materials of construction with respect to long-life performance and threat of fire.

By restricting the size of the heated area of the mirror so that safe low voltage operation with an esthetically acceptable small size and low cost transformer can be utilized, and by utilizing a moisture resistant low heat conductivity heat barrier, and by utilizing aluminum foil to equalize heat between heater wires, and by utilizing high temperature adhesives for safe continuous operation under worst-case high temperature conditions, we have invented a bathroom mirror heater which requires no special control devices for indefinitely long, safe, low-cost manufacture and low-cost operation.

Other objects and advantages of the present invention will be apparent upon reference to the accompanying description when taken in conjunction with the following drawings, which are exemplary.

DETAILED DESCRIPTION OF THE INVENTION

Keeping the mirror surface temperature above ambient temperature by any amount will prevent condensation in a 100% relative humidity environment. We achieve this goal for most bathrooms by optimizing the heater design so that the heater may be energised continuously at a nominal 18 watts. Under these operating conditions the materials of construction of the heater components must be capable of safe continuous operation at a safe margin above the worst case hot spot temperature of 132 degrees F. and perform in the humid environment characteristic of a bathroom, without deterioration over time. Worst case is defined as line voltage lot high and 100 degrees F ambient. All materials perform to 180 degrees F or better.

Figure 2:
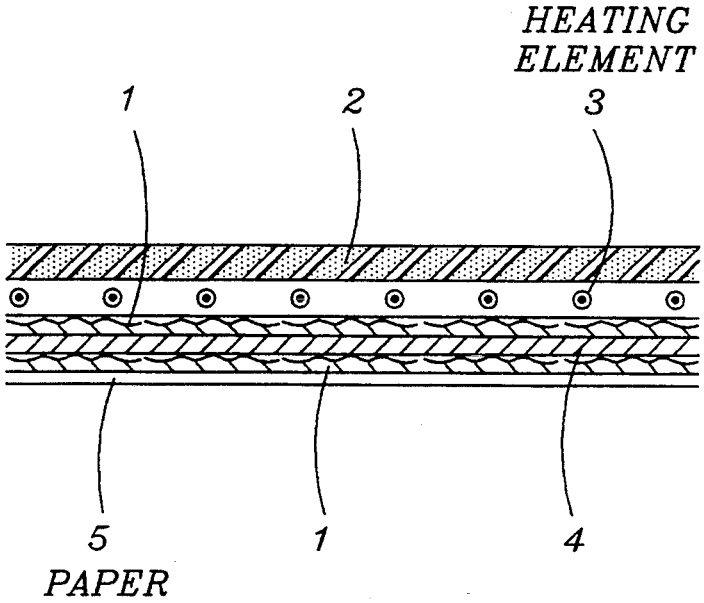
FIG. 2 is a crossection of the mirror heater structure for a low-voltage (24 volts) embodiment.

Referring to FIG. 2, 1 is an acrylic-based adhesive joining all the elements. 2 is a closed cell poyethelene foam, 3/16" thick with a 0.25 K-factor thermal conductivity (Volara 2A or equivalent). 3 is a PVC coated copper heater wire whose resistance is 30.4 ohms±5% and withstands a Hipot test of 1500 volts relative to the aluminum foil. It is necessary to use copper for low resistance heater wire. Copper has a high positive temperature coefficient of resistance and will typically rise 5% in value upon heating. For this reason the resistance design is 5% below that required for a nominal 18 watt design. 4 is an aluminum foil 2 mils thick which aids in distributing the heat more evenly between the wires. 5 is the peel-off paper which is removed to attach the heater to the mirror.

Figure 3:
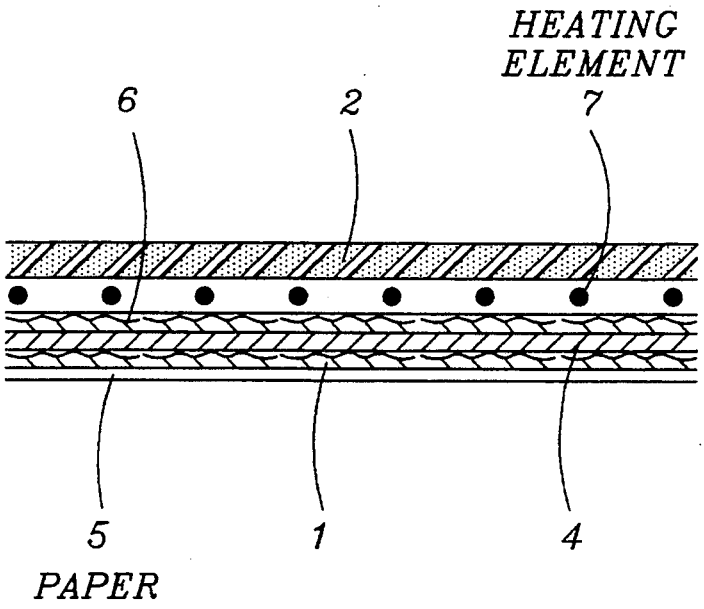
FIG. 3 is a crossection of the mirror heater for an alternative low-voltage (24 volts) embodiment.

Referring to FIG. 3 which represents an alternative low-voltage (24 volts) structure, the heater wire, 7, is solid 22-gauge nichrome (Hopkins Alloy 15) whose total resistance is 32 ohms±3%. 6 is a 1 mil polyester insulation (Hipot 300 volts) with acrylic adhesive on both sides.

Figure 4A:
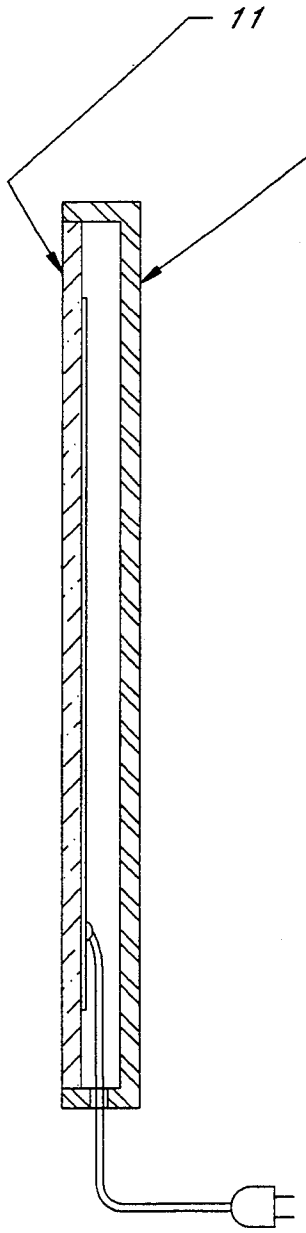
FIG. 4*a* and FIG. 4*b* show a longitudinal sectional view and a front view, respectively, of the sealed-enclosure version for line voltage operation.
Figure 4B:
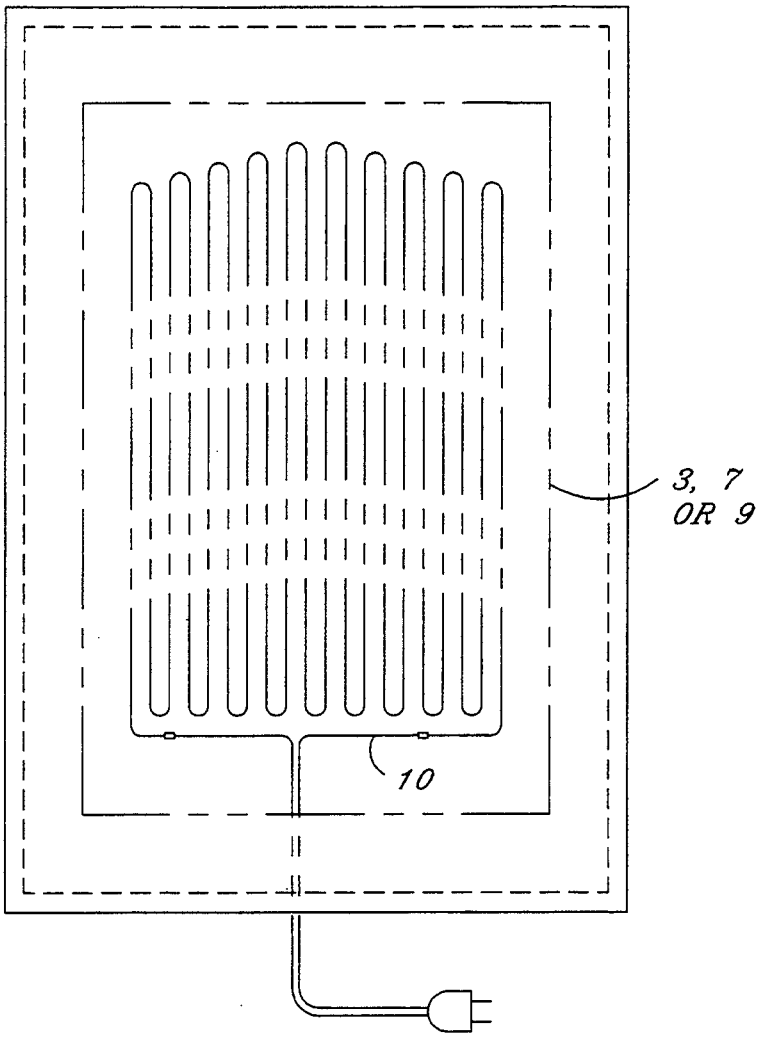

FIG. 4*a* and FIG. 4*b* show the mirror heater version that utilizes direct connection to line voltage which requires a sealed enclosure, 12, including the mirror, 11, for protection.

Figure 5:
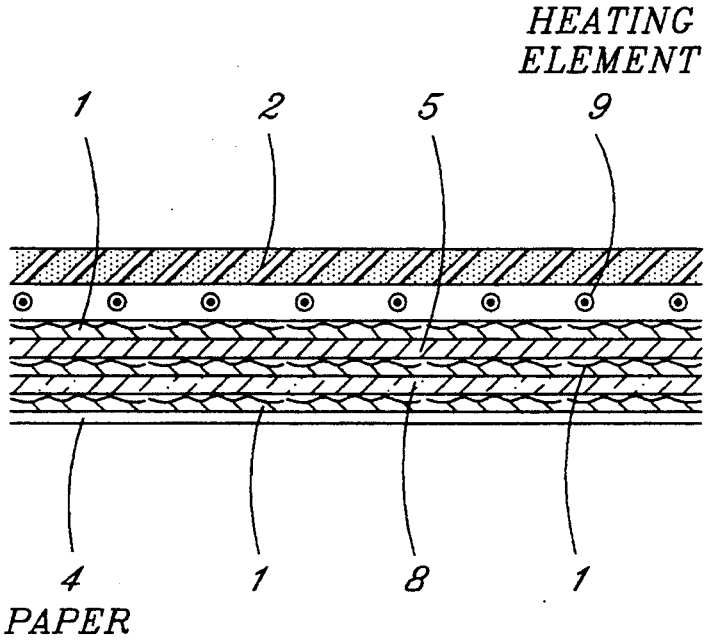
FIG. 5 is a crossection of the line voltage mirror heater shown in FIG. 4.

FIG. 5 show the crossection for the line voltage (120 volts) structure of FIG. 4. The heater wire, 9, for this version is PVC coated nichrome, 800 ohms±3% withstanding a hipot test of 1500 volts relative to the aluminum foil, 4. A mirror safety backing, 8, is required to protect the consumer from exposure to line voltage in the event the mirror breaks. A suitable material for this backing is Venture Tape Corporation's Mirraback 400.

Figure 1:
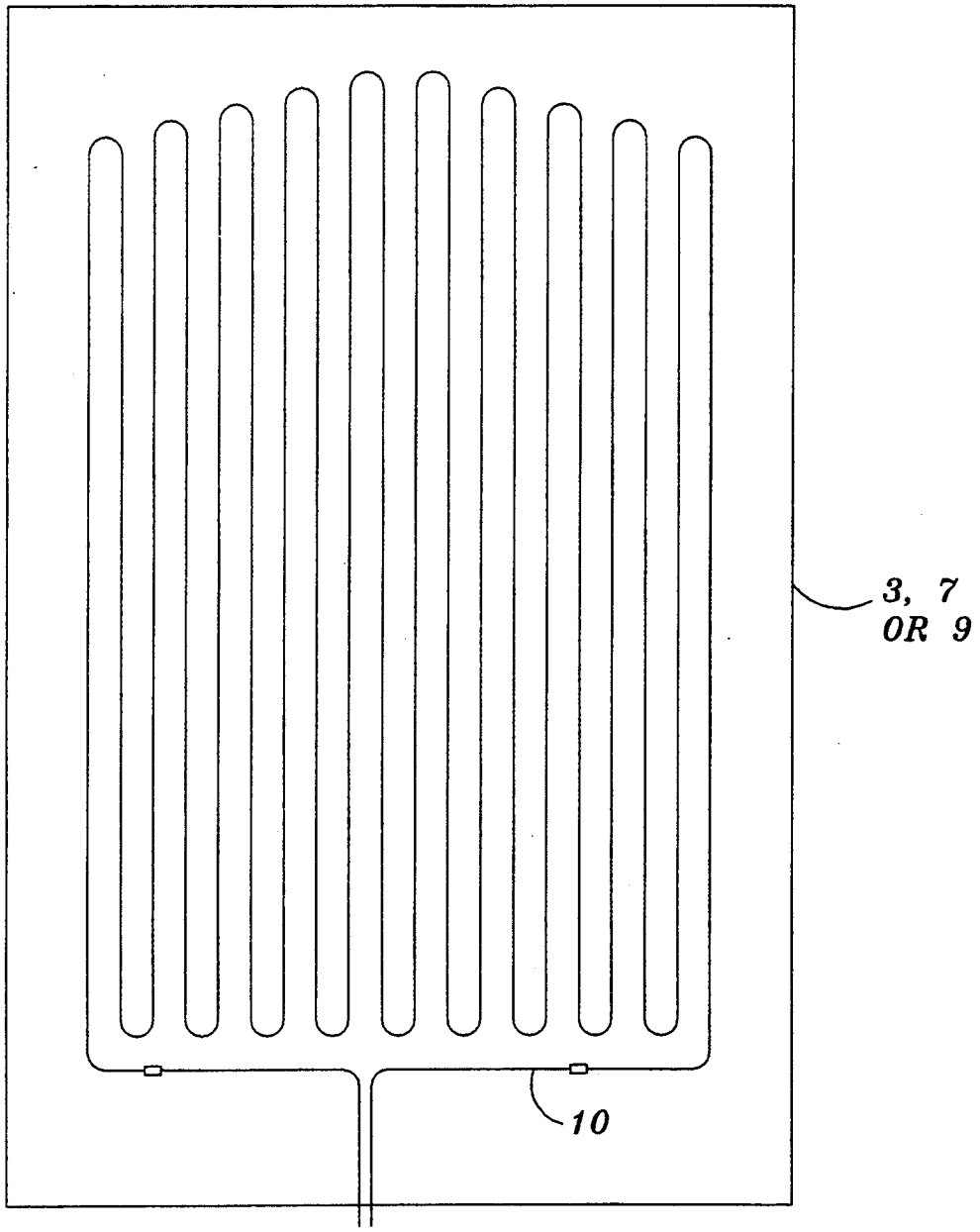
FIG. 1 is a plan view of the mirror heater showing the heater wires in relation to the whole structure.

Referring back to FIG. 1, lead wire, 10 is a fire-retardant PVC coated stranded copper wire 6 ft. long connecting to a 24 volt UL approved transformer. A suitable lead wire is American Electric Cordset's SPT-2 VW1 20/2 XT. A suitable transformer is Basler Electric's part #S-18956-0003.

SUMMARY OF TEST RESULTS

Tests were conducted in a small (310 cu. ft.) bathroom without air exhaust @ 108 volts (line voltage −10%) input to the 24 volt transformer and 65 degrees F ambient. Mirror surface temperatures were monitored, A 10 degrees F (71% of final) temperature rise occurs after 7 minutes of heat application. Heating for ½ hour was taken as equivalent to continuous pre-heating. The mirror was at 79 degrees F prior to turning on the shower. After a 15 minute shower at 110 degrees F the air temperature rose to 79 degrees F and the mirror to 83 degrees F. Thus, the air heated by the hot water also helps warm the mirror and contributes to keeping the heated mirror surface above the moisture-laden air temperature.

Tests in a 400 cu. ft bathroom without air exhaust resulted in a fog-free heated mirror area when operated by energizing the mirror heater via a light switch one minute before turning the shower on. Voltage was 108 volts; water temperature was 110 degrees F and ambient temperature was 65 degrees F.

The hot spot temperature was determined by testing an embedded thermocouple in the hottest part of the heater at 100 degrees F ambient and 132 volts applied to the transformer input. The hot spot temperature was 132 degrees F.

We claim:

1. An electric heating unit for attachment to a rear surface of a mirror to avoid the formation of condensation on a portion of the mirror surface; the heating unit comprising:

a layer of closed cell plastic foam; a single continuous insulating coated length of low resistance heater wire mounted on a surface of the foam layer; an aluminum foil covering the surface of the foam layer and the length of heater wire, and connected thereto via an adhesive; an adhesive layer covering the outer surface of the aluminum foil; a peel-off backing covering the adhesive layer to permit attachment of the heating unit to a mirror when the backing is removed; and means for connecting to the length of heater wire for supplying electrical current from a power source; and wherein the components of the unit produce less than 120 watts per square meter of heat to a mirror to which the unit is attached, the foam layer is a thin layer with a thermal conductivity factor K of approximately 0.25 BTU/ft$^2$/° F., the heater wire is formed of copper coated with a plastic and having a resistance of approximately 30 ohms, the aluminum foil is approximately 2 mils thick, and the power source is a low voltage supply of less than 30 volts.

2. A heating unit as defined in claim 1 wherein said unit has a maximum thickness of approximately one quarter inch.

3. A heating unit as defined in claim 1 wherein the adhesive is a high temperature acrylic based adhesive.

4. A heating unit as defined in claim 1 wherein the plastic foam layer is formed of polyethylene and has a thickness of approximately 3/16".

5. An electric heating unit for attachment to a rear surface of a mirror to avoid the formation of condensation on a portion of the mirror surface; the heating unit comprising:

a layer of moisture resistant low thermal conductivity material; a single continuous length of low resistance heater wire mounted on a surface of the moisture resistant layer and covered with an insulation material; an aluminum foil covering the surface of the moisture resistant layer and the length of heater wire, and connected thereto via an adhesive; an adhesive layer covering the outer surface of the aluminum foil; a peel-off backing covering the adhesive layer to permit attachment of the heating unit to a mirror when the backing is removed; and means for connecting to the length of heater wire for supplying electrical current from a power source; and wherein the components of the unit produce less than 120 watts per square meter of heat to a mirror to which the unit is attached, the moisture resistant foam layer is a thin layer with a thermal conductivity factor of approximately 0.25 BTU/ft$^2$/° F., the heater wire has a resistance of approximately 30 ohms, the aluminum foil is approximately 2 mils thick, and the power source is a low voltage supply of less than 30 volts.

6. A heating unit as defined in claim 5 wherein: said unit has a maximum thickness of approximately one quarter inch; said adhesive is a high temperature acrylic based adhesive; and said moisture resistant layer is a closed cell plastic foam layer having a thickness of approximately 3/16".

7. A heating unit as defined in claim 6 wherein said closed cell plastic foam is formed of polyethylene.

8. A heating unit as defined in claim 5 wherein said insulating material covering said heater wire is a plastic coating on said wire.

9. A heater unit as defined in claim 5 wherein said insulating material covering said heater wire is a layer of insulation material.

10. A heater unit as defined in claim 9 wherein the moisture resistant material is a closed cell plastic foam.

* * * * *